United States Patent [19]

Pai

[11] 4,408,421

[45] Oct. 11, 1983

[54] MANHOLE STRUCTURE

[76] Inventor: Yang-Kuang Pai, 2 Floor, No. 27, Lane 305, Wo-Lung St., Taipei, Taiwan

[21] Appl. No.: 259,483

[22] Filed: Apr. 30, 1981

[51] Int. Cl.[3] ..... E02D 29/14

[52] U.S. Cl. ..... 52/20; 404/26

[58] Field of Search ..... 52/19, 20, 21; 404/25, 404/26; 285/331

[56] References Cited

U.S. PATENT DOCUMENTS

| | | | |
|---|---|---|---|
| 2,431,082 | 11/1947 | Sayles | 404/26 |
| 3,308,727 | 3/1967 | Hurt | 404/25 X |
| 4,187,647 | 2/1980 | Hall | 404/26 X |
| 4,188,151 | 2/1980 | Hall | 52/21 X |
| 4,197,031 | 4/1980 | Hild | 404/26 |

FOREIGN PATENT DOCUMENTS

| | | | |
|---|---|---|---|
| 7404558 | 10/1975 | Netherlands | 404/26 |
| 68391 | 10/1944 | Norway | 285/331 |
| 197807 | 7/1978 | Switzerland | 52/19 |

*Primary Examiner*—John E. Murtagh
*Assistant Examiner*—Kathryn L. Ford
*Attorney, Agent, or Firm*—Edmund M. Jaskiewicz

[57] ABSTRACT

An improved manhole structure is disclosed which comprises a cover having a rim inclined inwardly at 45°, on which a plurality of protrusions are provided; a ring for elevating the cover, having an upright inner wall and outer wall and an upper face and lower face, both inclined inwardly at 45°, on the said upper face a plurality of holes are formed for engagement with the protrusions formed on the cover, and on the said lower face a plurality of protrusions are formed; and a base having an upper surface inclined inwardly at 45°, and a flat lower face, on the said upper surface a plurality of holes are formed for engagement with the protrusions formed on the lower face of the said ring.

5 Claims, 5 Drawing Figures

MANHOLE STRUCTURE

DETAILED DESCRIPTION OF THE INVENTION

This invention relates to the improved structure of a manhole. The improvement includes the structure of the manhole cover, the ring for elevating the manhole cover and its base.

Car drivers and passengers often feel the bouncing and jerking of the car or a sharp noise of knocking metal when the car was driven past a manhole in a city road. The cause of car bouncing and jerking is that the manhole cover is bulging out or hollow into the road surface, and the cause of metal knocking noise is that there is no means to secure the manhole cover and the ring which become loose or unlevel due to sand, mud or other foreign materials infiltrating therebetween, the result is that when the wheel of a passing car rolls over one side, the other side goes up and down to make a knocking noise.

As a result of investigation, the main causes for the unevenness of the manhole and the road surface are found to be:

(1) In raising the road surface, the manhole should also be raised at the same time so that it becomes level with the road surface. Because the conventional method of securing the manhole base is unsatisfactory, the work to raise the manhole is difficult, so it is not raised at the same time as the road is paved. Day after day and month after month, there are manholes left to be raised in almost every street.

(2) Generally, a manhole is raised by fixing it with concrete. If it needs to be raised again, the concrete must be knocked off to fix the manhole again. This method not only wastes manpower and money but also necessitates blocking the road to prevent cars running over till the concrete is solidified. This is unsightly and obstructing the traffic.

(3) In another conventional method of raising the manhole by adding rings (as shown in FIG. 1), the design is unsatisfactory and cannot overcome the practical difficulties, because the thickness of manhole cover 1 is 5 cm due to the restricted material strength and ring 2 for raising the manhole is also designed as 5 cm thick (it cannot be less than 5 cm), but usually the thickness of the additional pavement is 3 cm at a time (to raise the road surface 5 cm thick each time is very wasteful). Therefore after the manhole is raised, it bulges 2 cm above the road surface. If it is not raised, it hollows 3 cm below the road surface. This causes the unevenness of the road. The only way to solve this problem is to raise the manhole once for two layers of pavement. To compensate the 2 cm bulging above the road surface, the surface within 1 meter around the manhole is raised to form a slope. Therefore, the manhole on a newly paved road is like a dome. When a car is driven past, the car is still bouncing and jerking.

In addition to the above-mentioned situation, there is no device to secure the contact area between the manhole cover and the structure under it. Furthermore, a manhole cover is made of cast iron and becomes rusted after a certain period. It is difficult to open it without using special tools. This affects the efficiency of the work and delays the completion date.

This invention is to eliminate the shortcomings or the above-mentioned and to provide an improved manhole cover, a ring for raising manhole cover and an improved base.

The first object of this invention is to provide a manhole cover with securing means and a ring for raising the manhole for use in conjunction with such manhole cover.

The second object of this invention is to provide a base for use in conjunction with above-mentioned manhole cover or ring for raising manhole cover.

According to the above-mentioned improved structures of this invention, the thickness of the raised road surface can be kept always at level with the manhole and the work is quite simple.

How the foregoing objects and advantages are attained will appear more fully from the following description referring to the accompanying drawings in which.

Figure 2A:
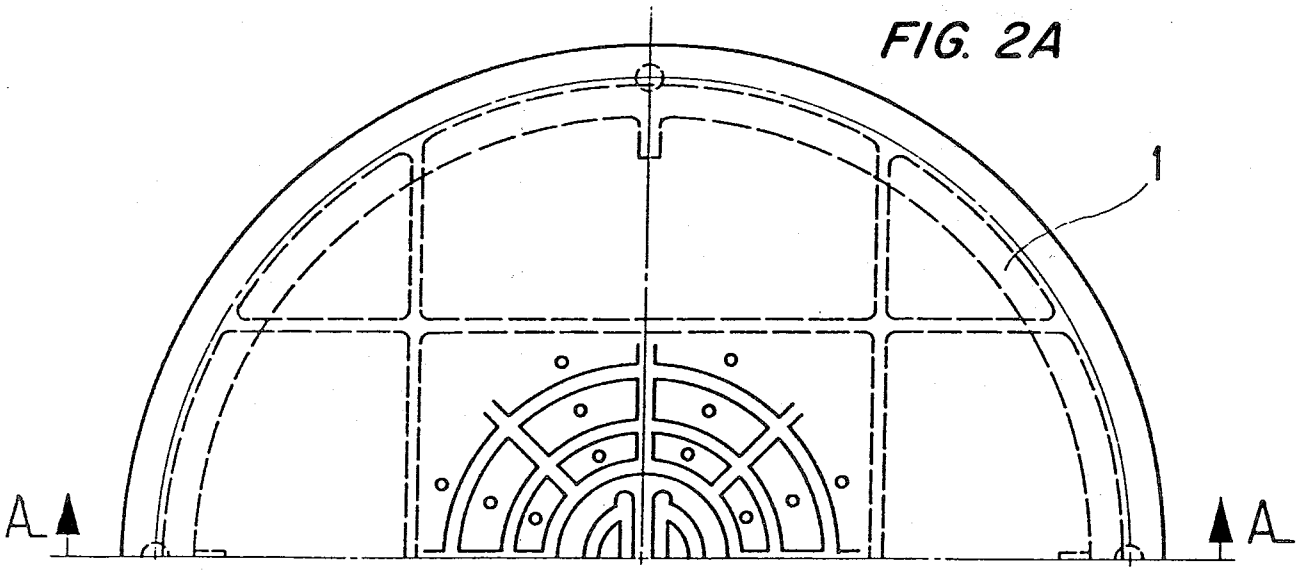
FIG. 2(A) is a partially plan view of the manhole cover of the present invention.
Figure 2B:
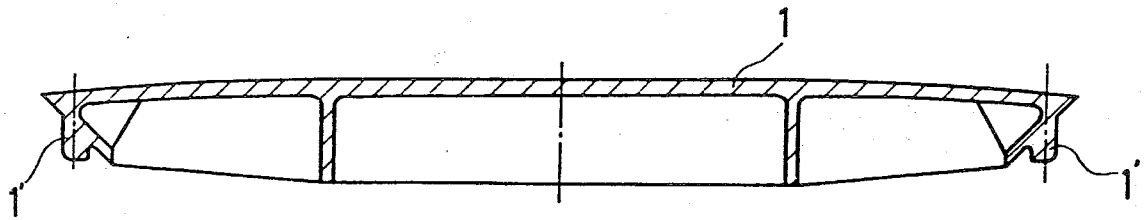
FIG. 2(B) is a sectional view of the manhole cover shown in FIG. 2(A)

The special feature in the construction of the present manhole cover 1 is shown in FIG. 2. The rim of manhole cover 1 has a surface inclining inwardly at 45° and in the middle of the inclining surface a suitable number of protrusions 1' for insertion are formed downwards. In the drawing, protrusions 1' are formed at the meeting place of the right angled diameters passing through the centre of manhole cover 1 and the inclining surface. Thus 4 protrusions 1' are formed. The other structure of the manhole cover is the same conventional one and is made of cast iron.

Figures 3A, 3B:
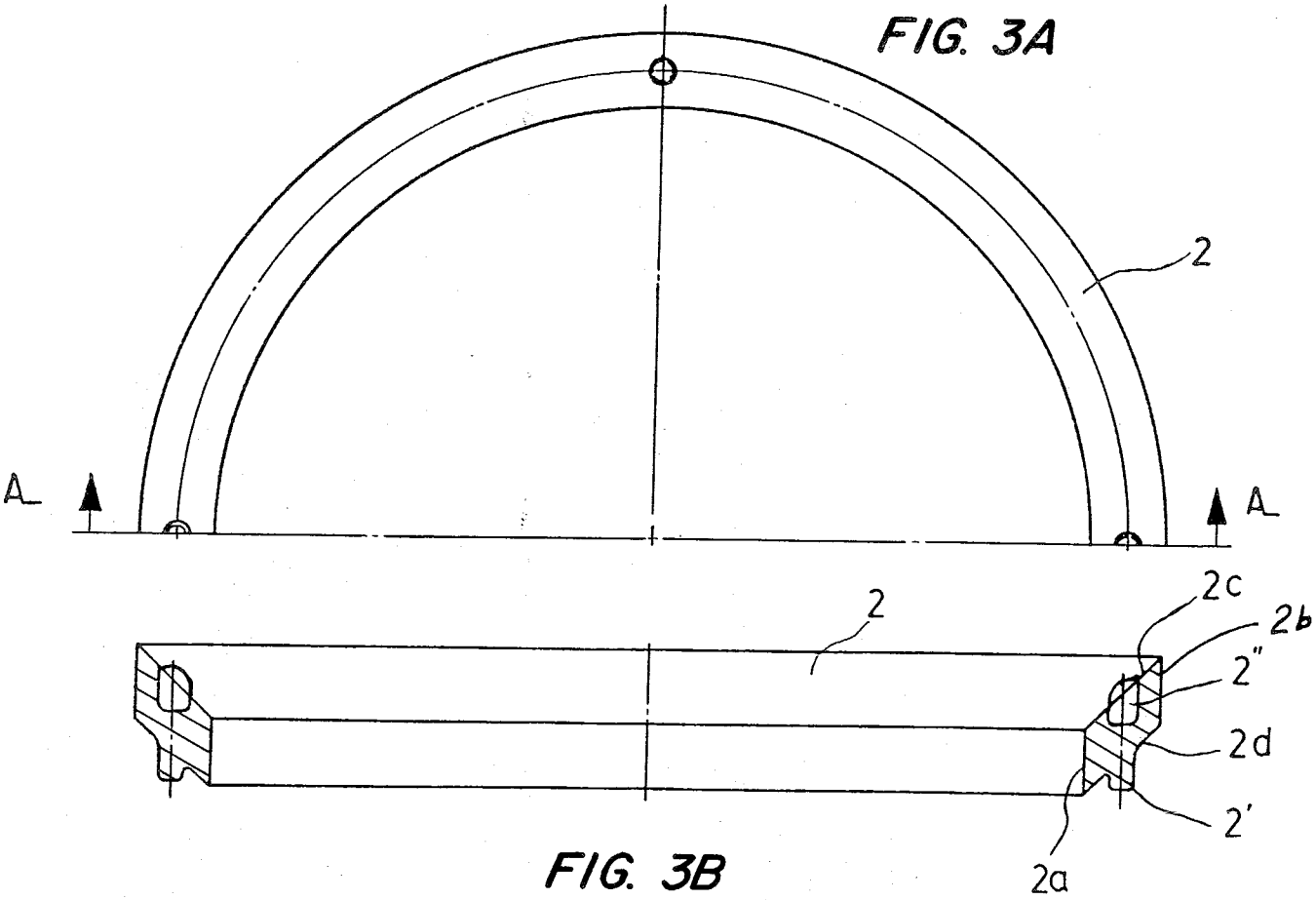
FIG. 3(A) is a partially plan view of the ring used in connection with manhole cover of the present invention.
FIG. 3(B) is a sectional view of the ring shown in FIG. 3(A)

The ring 2 for raising the manhole cover of this invention as shown in FIG. 3 has a perpendicular inner wall 2*a* and outer wall 2*b*, and upper wall 2*c* and lower wall 2*d* which are parallel and inclined inwardly at 45° with walls 2*a* or 2*b* forming a ring shape structure. In the middle of the upper wall 2*c* a hole 2'' is formed for receiving the corresponding protrusions 1' of the above-mentioned manhole cover. In the middle of lower wall 2*d* a downward protrusions 2' is formed in corresponding to the above-mentioned hole 2''.

Figures 4A, 4B:
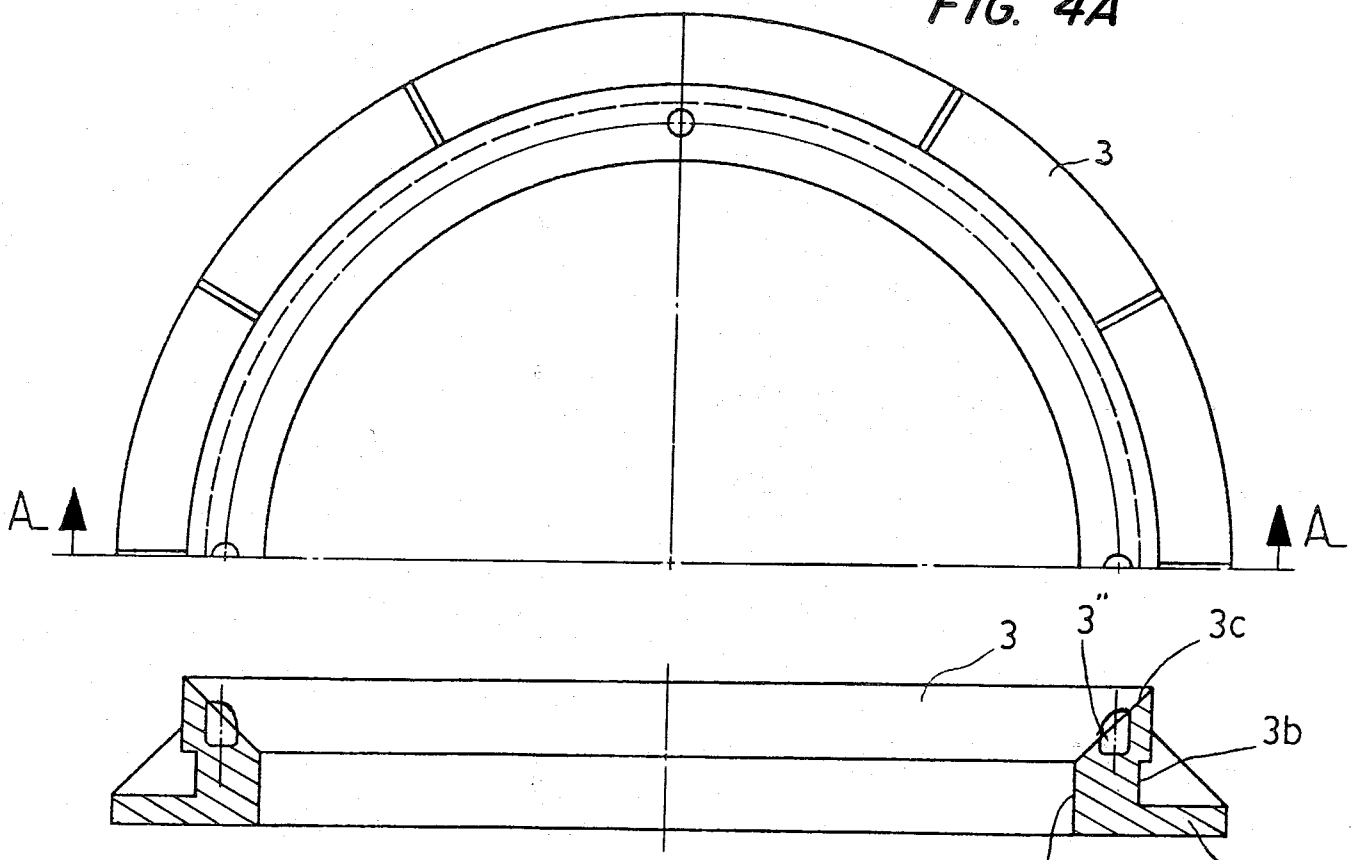
FIG. 4(A) is a partially plan view of the base used in connection with the ring of FIG. 3.
FIG. 4(B) is a sectional view of the base shown in FIG. 4(A)

The base 3 for manhole cover of this invention as shown in FIG. 4 is a ring shape structure like ring 2 but its base 3*d* has a protruding rim without protrusions. In the middle of the inclined surface of its upper wall 3*c*, holes 3'' are formed in corresponding to the above-mentioned protrusions 1' or 2'.

Figure 1B:
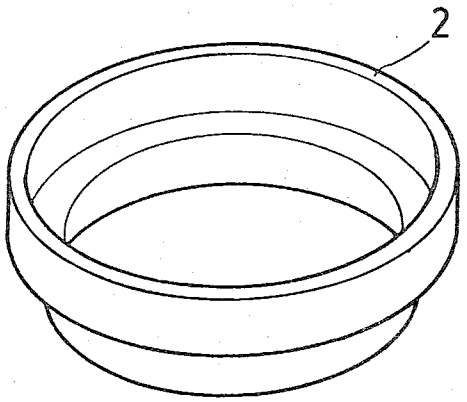
PRIOR ART FIG. 1B
FIG. 1(B) is a perspective illustration of a ring used in the conventional manhole structure shown in FIG. 1(A)
Figure 1A:
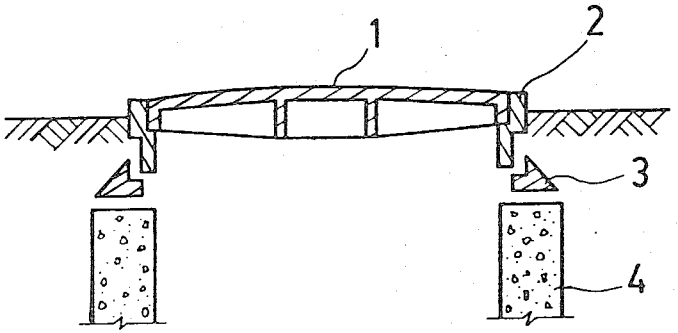
PRIOR ART FIG. 1A
FIG. 1(A) is a sectional schematic illustration of a conventional manhole structure.
Figure 5:
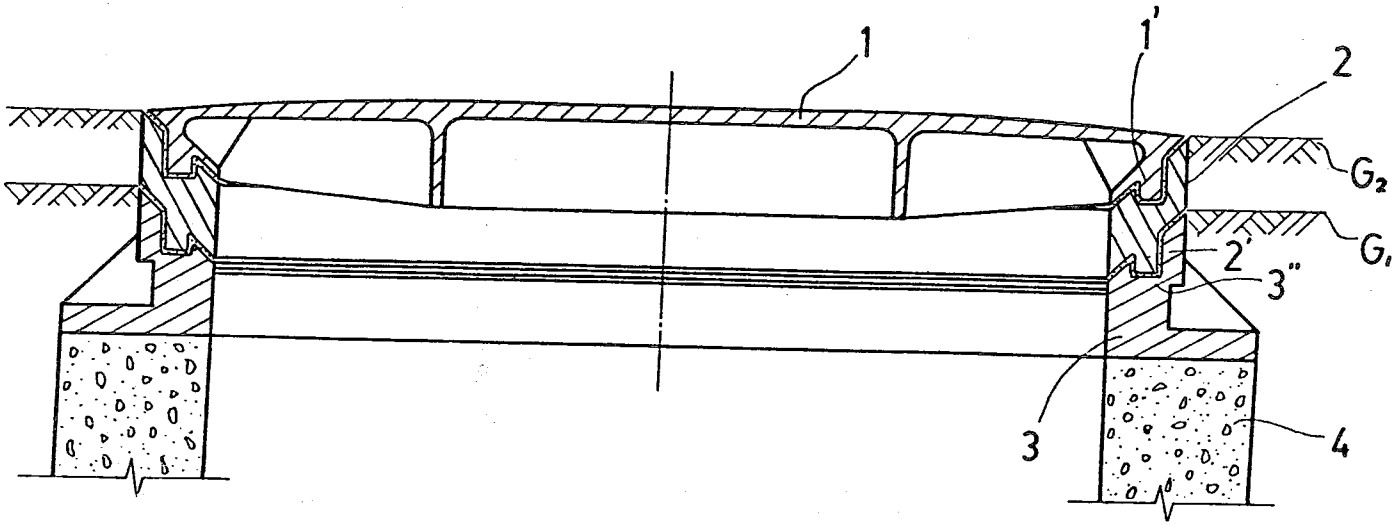
FIG. 5 is a sectional view of the present manhole structure.

The assembly of manhole cover 1, ring 2 and base 3, having the above-mentioned structure, is shown in FIG. 5 embodiment. In installation, base 3 is placed first on concrete base 4 and then protrusions 1' of the manhole cover 1 are inserted into the holes 3″ in base 3, thus the manhole cover 1 is securely positioned on base 3, after that, the road surface is raised 3 cm to G1. If the road surface is required to be raised again after a certain time of use, a ring 2 can be placed on base 3 in the same manner as described above. After covering the manhole with manhole cover 1, a proper thickness of road surface G2 can be raised. Therefore, the operation of raising the manhole is quite simple and the engagement of cover and manhole is firm and secure. Unlike the conventional ring formed by coupling 2 rings of different diameters (as shown in element 2 in the cross section of FIG. 1), the height of ring 2 of this invention is not fixed and may be made to conform with the height of the road surface to be raised, e.g. 3 cm. After the installation of above said ring, the road surface can be raised 3 cm according to the work specification without any bulging part on the road surface and the surface will remain level, thus bouncing and jerking of the car running thereon and knocking noise from unlevel cover would not occur. Furthermore, to prevent the manhole cover from sticking onto the base or the ring due to rusting, a rubber cushion may be provided between the adjoining surfaces so as to facilitate opening the manhole cover and to save working time.

While a preferred embodiment has been described, variations thereto will occur to those skilled in the art within the scope of the present inventive concepts. The scope of the invention is therefore to be determined solely by the appended claims.

What is claimed is:

1. An improved manhole structure, which comprises;

(a) a circular cover having a rim inclined at 45° inwardly of the periphery of said cover to define a continuous conical contact surface, a plurality of lug protrusions extending from said contact surface;

(b) a ring having an axial inner wall and an axial outer wall and an upper face and a lower face, both said upper and lower faces being inclined inwardly at 45° to define continuous conical surfaces, on the said upper face there are a plurality of holes so shaped and located to engage with the protrusions on the cover contact surface, and on the said lower face there are a plurality of lug protrusions, and (c) an annular base having an upper surface inclined inwardly at 45° and a flat lower face, on the said upper surface there are a plurality of holes so shaped and located to engage with the protrusions formed on the lower face of the said ring.

2. An improved manhole structure as recited in claim 1, wherein the inwardly inclined face of the said cover, ring and base is at 45 degrees.

3. An improved manhole structure as recited in claim 1, wherein the engaging surface of the cover and the ring, and that of the ring and base are provided with a cushioning means.

4. An improved manhole structure as recited in claim 3, wherein the cushioning means is a rubber made cushion.

5. An improved manhole structure as recited in claim 1, wherein the said cover, ring and base are of annular shape.

* * * * *